US009903682B1

(12) United States Patent
Fyksen, Jr. et al.

(10) Patent No.: US 9,903,682 B1
(45) Date of Patent: Feb. 27, 2018

(54) ARCHERY BOW FLOATATION DEVICE

(71) Applicants: Dennis R. Fyksen, Jr., Adams, WI (US); Jill V. Fyksen, Adams, WI (US); Dennis R. Fyksen, III, Adams, WI (US); David E. Fyksen, Adams, WI (US)

(72) Inventors: Dennis R. Fyksen, Jr., Adams, WI (US); Jill V. Fyksen, Adams, WI (US); Dennis R. Fyksen, III, Adams, WI (US); David E. Fyksen, Adams, WI (US)

( * ) Notice: Subject to any disclaimer, the term of this patent is extended or adjusted under 35 U.S.C. 154(b) by 0 days.

(21) Appl. No.: 15/173,125

(22) Filed: Jun. 3, 2016

(51) Int. Cl.
*F41B 5/14* (2006.01)
*B63B 22/00* (2006.01)
*F41B 5/06* (2006.01)

(52) U.S. Cl.
CPC ..... *F41B 5/1488* (2013.01); *B63B 22/00* (2013.01); *F41B 5/066* (2013.01); *F41B 5/1403* (2013.01)

(58) Field of Classification Search
CPC .. F41B 5/00; F41B 5/14; F41B 5/1484; F41B 5/1488; A01K 91/02
USPC ..... 124/23.1, 86, 88; 43/25; 441/1, 129
See application file for complete search history.

(56) References Cited

U.S. PATENT DOCUMENTS 1,580,227 A 4/1926 Wilhelm
2,892,198 A * 6/1959 Gruenbergor ..... B63B 22/14 43/23
4,002,236 A * 1/1977 Tolleson ..... A45C 11/24 124/25
4,024,667 A * 5/1977 Wegener ..... A01K 91/02 124/23.1
5,000,482 A 3/1991 Cimino et al.
5,019,000 A 5/1991 Stephens et al.
D327,697 S 7/1992 Vines
5,341,590 A 8/1994 Hepworth et al.
D368,272 S 3/1996 Starr et al.
5,503,579 A * 4/1996 Curran ..... A01K 87/00 43/18.1 R
5,592,773 A * 1/1997 Perry ..... A01K 87/00 43/25
5,727,974 A 3/1998 Wiebenson et al.
5,862,622 A * 1/1999 Sandman ..... A01K 87/007 43/25
5,896,693 A 4/1999 Ray
(Continued)

FOREIGN PATENT DOCUMENTS

WO 03101825 A1 12/2003
WO 2014/153028 A1 9/2014

OTHER PUBLICATIONS

AMS Bowfishing, "AMS Bowfishing Big Game Mega Float," http://www.gandermountain.com/modperl/product/details.cgi?pdesc=AMS-Bowfishing-Big-Game-Mega-Float&i=429291, Internet printout of product information, 3 pages.
(Continued)

*Primary Examiner* — Alexander Niconovich
(74) *Attorney, Agent, or Firm* — Boardman & Clark LLP

(57) ABSTRACT

A floatation device for an archery bow is disclosed. The floatation device has a buoyant member defined by a top, a bottom, and one or more sides wherein the bottom is arranged to meet an arch of an archery bow limb. A securing mechanism arranged to secure the buoyant member on the bow limb is provided in such a way that the buoyant member is in contact with the bow limb. An aquatic archery bow having a floatation device thereon is also disclosed.

21 Claims, 7 Drawing Sheets

(56) References Cited

U.S. PATENT DOCUMENTS

| | | | | |
|---|---|---|---|---|
| 6,273,774 | B1 * | 8/2001 | Warzecha | B63B 7/02 441/129 |
| 6,332,819 | B1 * | 12/2001 | Emmons | A44B 15/005 441/1 |
| 6,953,034 | B2 * | 10/2005 | May | A01K 81/00 124/17 |
| 6,986,221 | B2 * | 1/2006 | Mullis | F41A 23/02 42/74 |
| 7,712,244 | B2 | 5/2010 | Mamae | |
| 7,762,860 | B2 * | 7/2010 | Reed | B63B 22/24 441/23 |
| 7,789,080 | B2 | 9/2010 | Fielding | |
| 8,434,466 | B2 * | 5/2013 | Woods, Jr. | F41B 5/14 124/86 |
| 8,518,505 | B2 * | 8/2013 | Huang | A01K 87/08 428/35.7 |
| 8,720,424 | B2 | 5/2014 | Kempf | |
| 8,800,578 | B2 | 8/2014 | Jackson | |
| 8,821,206 | B2 | 9/2014 | Van Mil et al. | |
| 8,888,545 | B2 * | 11/2014 | Rossini | B63B 22/00 441/1 |
| 9,043,999 | B1 * | 6/2015 | Boester | A01K 89/02 |
| 9,101,119 | B2 | 8/2015 | Dunlop et al. | |
| 9,220,249 | B1 * | 12/2015 | Bailey | A01K 81/04 |
| 2004/0121672 | A1 * | 6/2004 | McLarty | B63B 22/12 441/113 |
| 2009/0093177 | A1 | 4/2009 | Reed et al. | |
| 2011/0005120 | A1 * | 1/2011 | de Koning | A01K 87/00 43/19 |
| 2011/0065342 | A1 * | 3/2011 | Hudson | B63C 11/26 441/16 |
| 2012/0315813 | A1 * | 12/2012 | Rossini | B63B 22/00 441/1 |
| 2015/0157001 | A1 * | 6/2015 | Mayer | A01K 91/06 43/4.5 |

OTHER PUBLICATIONS

MUZZY Outdoors LLC, "MUZZY Big Game Float/Reel Combo," http://www.muzzy.com/muzzy-big-game-float-reel-combo/, Internet printout of product information, 2 pages.

* cited by examiner

ARCHERY BOW FLOATATION DEVICE

FIELD

The present invention relates to the field of accessories for bows used in, on, and near water. The present inventions more specifically relate to the field of accessories for bows for aquatic archery.

BACKGROUND

Aquatic archery, sometimes known as bowfishing or archery fishing, is a fast-growing, outdoor sport in which an operator uses an archery bow, arrows, and lines to shoot and retrieve fish. Although aquatic archery can be done from the shore, more often, operators shoot from boats or while standing in or near the body of water. Fish are shot with an arrow that is attached with special line to a reel mounted on the bow. The bow may be laid down once the fish is reeled to be collected, to help others, or for a variety of other reasons. At that point, the bow is vulnerable to falling into the body of water.

An aquatic archery bow is often lost as an operator accidentally knocks the bow into the water. Unfortunately, bows are typically made of material(s) that are not buoyant. Moreover, bows are expensive. Even starter bows are costly, with the price increasing as the quality of the bow increases. Additionally, once the bow owner adds the necessary arrows, reels and line, and any other desired accessories, the material needed for aquatic archery becomes quite expensive. Therefore, a lost bow not only ends the activity until a new bow and accessories can be purchased, it can be financially detrimental to the owner of the bow.

Accordingly, a need exists for a floatation device that is securable to an aquatic archery bow, and which can easily be added to any bow. A need also exists for such a device which does not affect the performance or usability of the bow.

SUMMARY

Accordingly, a floatation device for an archery bow is disclosed. The floatation device has a buoyant member defined by a top, a bottom, and one or more sides wherein the bottom is arranged to meet an arch of an archery bow limb. A securing mechanism arranged to secure the buoyant member on the bow limb is provided in such a way that the buoyant member is in contact with the bow limb.

Additionally, a floatation device for an archery bow having at least one bow limb with a top, at least two sides and a bottom is also disclosed, wherein the floatation device has a buoyant member with an inner cavity. The inner cavity is shaped to meet an arch of at least one bow limb. The floatation device is secured to the bow limb in such a way that a surface of the inner cavity of the buoyant member is in contact with the at least one archery bow limb.

An aquatic archery bow is also disclosed. The aquatic archery bow has a plurality of bow limbs. A floatation device is secured to a bow limb from the plurality of bow limbs. The floatation device comprises a buoyant member defined by a top, a bottom, and one or more sides. The buoyant member is carried by an arch of the bow limb and the buoyant member is secured to the bow limb. The floatation device further comprises an arrow retention mechanism located on the buoyant member which detachably holds or retains a projectile.

A floatation device that is securable to a bow is provided. The floatation device is secured, but removable, to the bow.

Preferably, but not necessarily, the securement is in such a way that it does not impair the motion of the arrow, flexing of the bow, or movement of the line, nor does it impair the sight line or picture, or aiming accuracy of the aquatic archer. The floatation device is buoyant enough to maintain at least a portion of the bow above water to be easily retrieved. Additionally, the floatation device may be colored, painted or coated in such a way to help increase its visibility so as to allow easy retrieval in low visibility settings. In addition, lights or other attention-attracting devices may be incorporated to increase visibility.

The floatation device comprises a buoyant member. The buoyant member may be formed to fit the curve of the bow. Alternatively, or additionally, the buoyant member may be flexible enough to bend so as to match the curve of the bow and bend with the bow as it is used. In one example of embodiments, this flexibility may be due to material that is itself flexible. In alternative examples of embodiments, a plurality of buoyant members may be secured to a flexible platform.

According to one or more examples of embodiments, the buoyant member is secured, but removable, to the bow. However, it is contemplated that in certain embodiments the buoyant member may be permanently or semi-permanently secured. The buoyant member is preferably secured in such a way that it is not dislodged from the bow even if dropped into water from a distance. In addition, the buoyant member and its securement mechanism(s) remain flexible enough to allow proper flexing of the bow's limbs for use.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
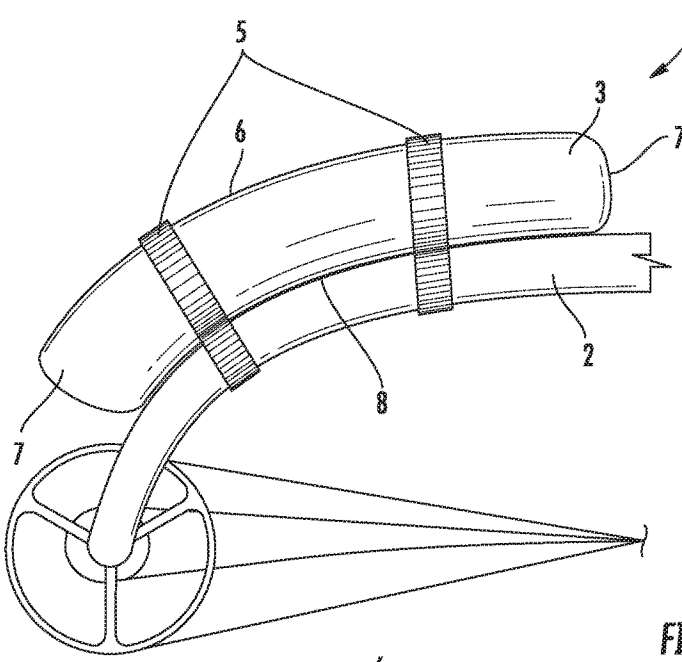
FIG. 1 illustrates a side elevation view of one or more examples of embodiments of a floatation device, showing the floatation device secured to a portion of a bow and having a plurality of separate securement mechanisms.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Generally, the present invention is an accessory for archery bows used in, on, and near water and specifically for use with aquatic archery. Namely, a floatation device for an archery bow comprising of one or more buoyant members that are secured to the archery bow is provided. When secured, the floatation device allows the bow to float at or near the surface of the water. Additional features such as lights, reflectors, or bright colors help with visibility of the bow, which features are particularly helpful if the bow is in a body of water.

Referring to the Figures, a floatation device for an archery bow is provided. The floatation device has a buoyant member defined by a top, a bottom, and one or more sides. The bottom may be shaped to meet the longitudinal arch of an archery bow limb. A securing mechanism holds the buoyant member in such a way that the bottom of the buoyant member is on an archery bow limb. To this end, an aquatic archery bow is also provided. The bow has two bow limbs with a plurality of floatation devices, wherein each bow limb has a secured floatation device. As indicated, the buoyant member is in contact with at least one of the bow limbs. An arrow retention mechanism may also be located to the top or side of the buoyant member in which the mechanism detachably holds or retains a projectile, such as for example an arrow.

FIGS. 1-9 show one or more examples of embodiments of the floatation device 1 secured on an archery bow limb 2. The floatation device 1 includes a buoyant member 3 and one or more securing mechanism(s) 4 or 5. The bottom 8 of the buoyant member 3, or the buoyant member 3 itself is formed to generally fit the curve of a bow limb 2 or is flexible enough to curve with, fit, and/or at least partially surround the bow limb 2. In the illustrated embodiment of FIG. 1, the securing mechanism(s) 4 or 5 is placed to ensure the bow limb 2 can bend and flex as needed to allow proper usage of the bow. The floatation device 1 may be used singly or in pluralities and/or on one or both bow limbs 2. In one or more preferred examples of embodiments, a plurality of floatation devices 1, and in particular two floatation devices 1, may be provided, respectively secured or securable to both bow limbs 2.

In one or more examples of embodiments, the buoyant member 3 and the buoyant chambers 10 are made of buoyant material. In this regard, the buoyant member 3 and chambers 10 may be formed of material including plastic or other polymer, rubber, or urethane, as well as combinations of the foregoing. Alternatively, the buoyant member 3 or chamber may be formed of, or include closed cell foam, open cell foam, or other now known or future developed buoyant material, used alone or in combination with the foregoing described buoyant materials.

In addition to being formed of buoyant material, the floatation device 1 may be formed of materials that are antimicrobial or at least resistant to bacteria, fungus, plants and other undesirables. The buoyant member 3 may also be watertight to prevent water from soaking into the buoyant member 3 and chambers 10, and thereby prevent the buoyant member 3 from becoming heavy and/or a habitable environment for bacteria, fungus, plants and other undesirables. For instance, the floatation device 1 may be comprised of a watertight covering. As a non-limiting example, the buoyant member 3 or individual chambers 10 may be comprised of vinyl coated (e.g., a watertight covering) closed-cell foam or foam rubber. The exterior of the buoyant member 3 may also or alternatively be plasticized or otherwise covered.

Figure 3:
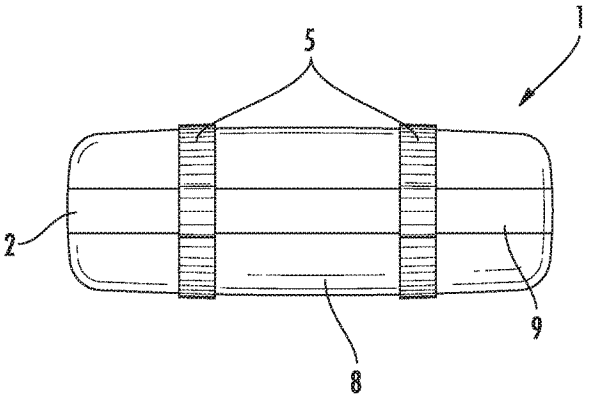
FIG. 3 illustrates a bottom plan view of the floatation device shown in FIG. 1, also showing a groove or cavity in the floatation device.
Figure 4:
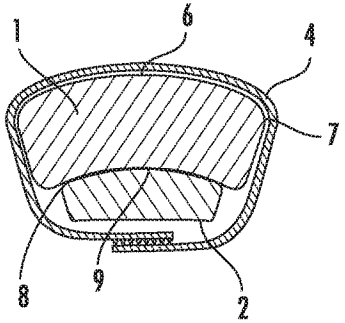
FIG. 4 illustrates a cutaway elevation view of the floatation device shown in FIG. 1.
Figure 6:
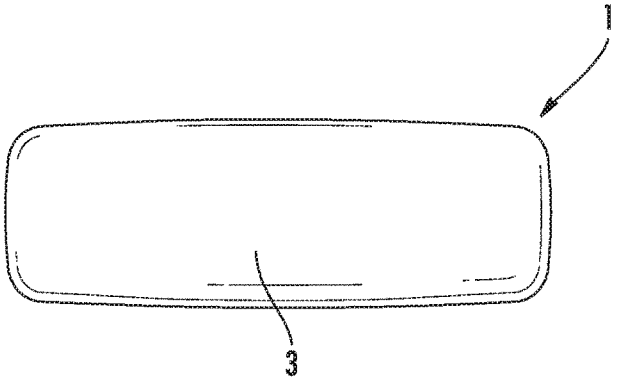
FIG. 6 illustrates a top plan view of the floatation device shown in FIG. 5.
Figure 7:
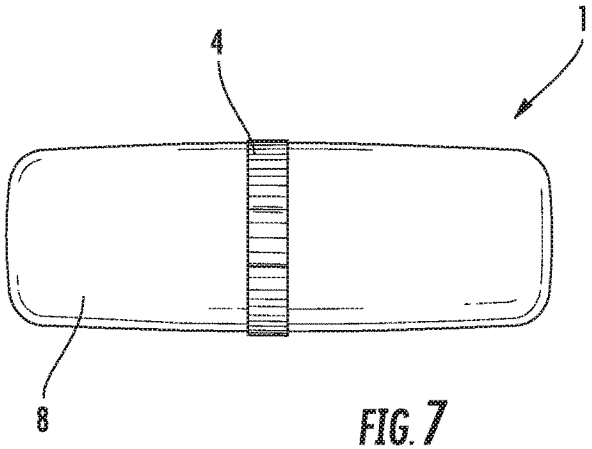
FIG. 7 illustrates a bottom plan view of the floatation device shown in FIG. 5.
Figure 5:
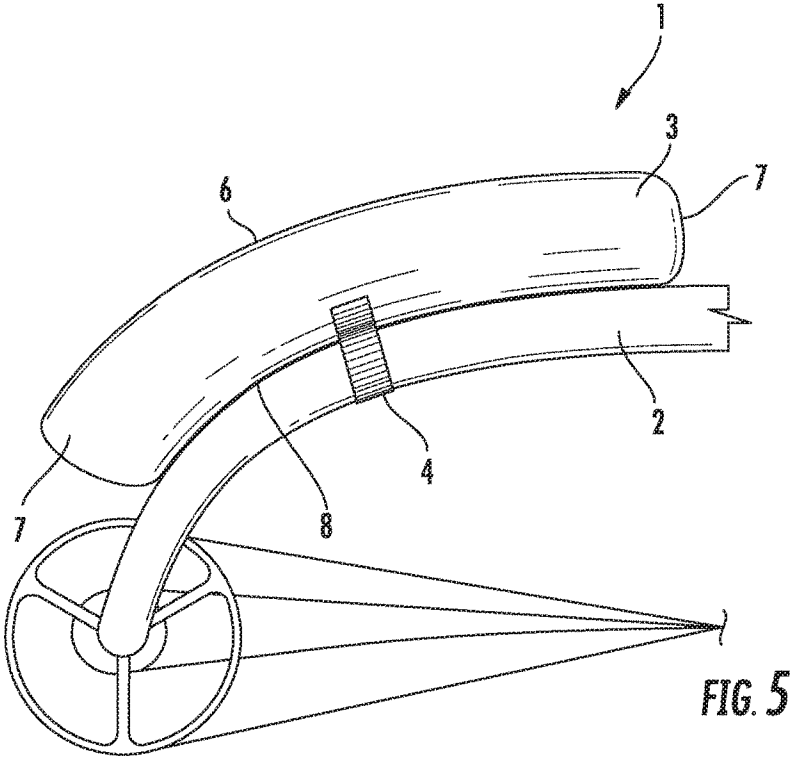
FIG. 5 illustrates a side elevation view of one or more alternative examples of embodiments of a floatation device, showing the floatation device secured to a portion of a bow and having one securement mechanism attached on one end to the floatation device.

The floatation device 1 is provided for an archery bow with at least one bow limb 2. As indicated, the floatation device 1 has a top 6, at least two sides 7, and a bottom 8. Referring to FIG. 3, the bottom 8 of the buoyant member 3 may form a concave cavity 9 which conforms to a portion of the bow limb 2. For example, the buoyant member 3 may have a concave cavity 9 on at least one surface 8 which may optionally have a shape conforming to a latitudinal and/or longitudinal arch on the bow limb 2 (FIG. 1). To this end, the buoyant member 3 may be defined by an inner or bottom cavity and an outside wherein the inner cavity is shaped to meet an arch of at least one bow limb 2 and wrap around the sides of the bow limb 2 to secure the floatation device 1 to the bow limb 2 in such a way that a surface of the inner cavity of the buoyant member 3 is in contact with the archery bow limb 2. Alternatively or additionally, the top of the buoyant member 3 may be convex to conform to the bow limb 2, including, but not limited to, a shape which conforms to an arch on the bow limb 2. As shown in FIGS. 5-7, the floatation device 1 may alternatively have a buoyant member 3 without a cavity. In a further alternative example of embodiments, the buoyant member 3 may include shaped sides 7 which overhang the edge of the bow limb 2 when attached (see e.g., FIG. 13). In one example, the floatation device 1 has an inner cavity that wraps around the two sides and the bottom of at least one bow limb 2 in such a way that the surface of the inner cavity of the buoyant member 3 is in contact with the archery bow limb 2 on both the sides and the bottom of the bow limb 2 (see e.g., FIG. 11).

As indicated herein, the floatation device 1 may be formed or shaped, or provided with a degree of flexibility that conforms to an arch on a bow limb 2. As is known, a bow limb 2 may have a convex arch, or a concave arch, or combinations of the foregoing (e.g., a "hybrid"). The floatation device 1 may be suitable for use with any now known or future developed bow and bow arch.

Figure 8:
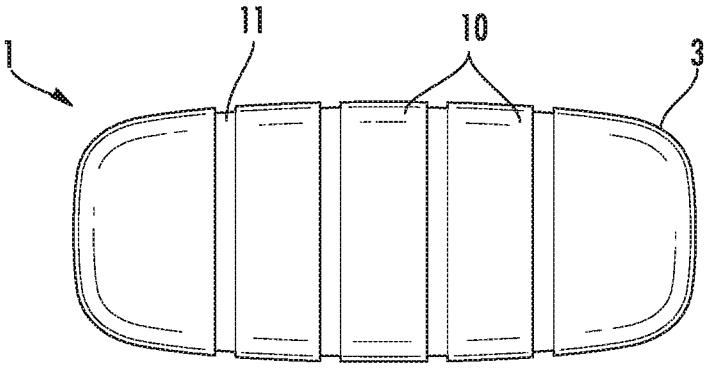
FIG. 8 illustrates a top plan view of one or more alternative examples of embodiments of the floatation device, showing a device having a plurality of buoyant portions secured to a flexible base.

The floatation device 1 may also or alternatively have a plurality of buoyant members 3 joined to a flexible base (see e.g., FIG. 8). For instance, the floatation device 1 may be composed of a flexible platform 11 with a top and a bottom; a plurality of the buoyant members 3 (e.g., the bottom thereof) are fixed to the top of the flexible platform 11 to connect a plurality of buoyant members 3 together so as to form a single floatation device. FIG. 8 shows one or more examples of embodiments of the floatation device 1 with multiple buoyant members 3 or chambers 10 forming the buoyant member 3. The multiple or plurality of buoyant members 3 or chambers 10 in the illustrated example are connected to the flexible platform 11 or base, in which platform 11 or base is in contact with the bow limb 2. Alternatively, it is contemplated that multiple buoyant members 3 or chambers 10 may be independently attached to the bow limb 2 without departing from the overall scope of the present invention.

Figure 2:
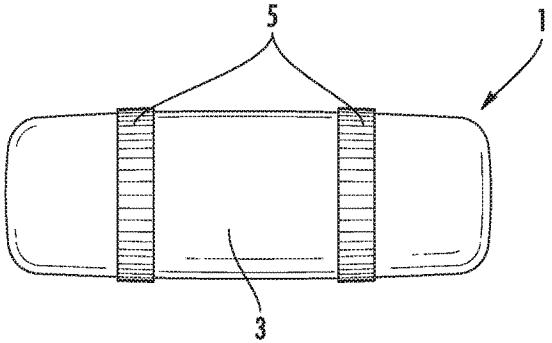
FIG. 2 illustrates a top plan view of the floatation device shown in FIG. 1.

As indicated and shown generally in FIGS. 1-7, the floatation device 1 may be secured on the bow limb 2 by a securing mechanism. In one or more examples of embodiments, this securing mechanism is one or more straps (compare FIGS. 1 & 3, 5 & 7). A single strap 4 as shown in FIGS. 5-7, or a plurality of straps 5 as shown in FIG. 1-3, may be used to secure the buoyant member 3 to the bow limb 2. The straps 4 or 5 may be attached to the floatation device 1 or may be separate elements which surround the floatation device 1 and bow limb 2. In one or more examples of embodiments (see FIG. 1), two securing mechanisms 5 are shown. In FIG. 5, a single strap 4 is shown. The buoyant member 3 may be fixed to the securing mechanism 4 or 5. For instance, the straps 4 and/or 5 may be directly connected to the buoyant member 3 (FIG. 5) or may be disconnected from (e.g., a separate component) the buoyant member 3 (FIG. 1). If the straps 5 are connected to the buoyant member 3, one or more straps 4 and/or 5 may be directly connected or secured to any one or more of the top 6, side(s) 7 and/or bottom 8 of the buoyant member 3. The straps 4 and/or 5 in this example of embodiments may be secured to the buoyant member 3 by any suitable means. In this regard, the strap(s) 4 and/or 5 may extend on one end from the buoyant member 3 and wrap around a portion of the buoyant member 3 and bow limb 2 (when present) and secured to the buoyant member 3 or secured to itself (e.g., a portion of the strap). The straps 5 may circumnavigate the buoyant member 3 and the bow limb 2 as shown in FIGS. 1-7 to allow the buoyant member 3 to be secured to the bow limb 2.

Figure 9:
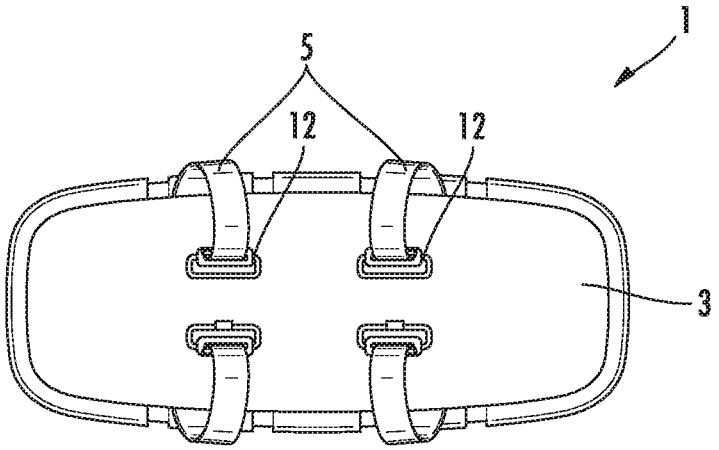
FIG. 9 illustrates a bottom plan view of the floatation device shown in FIG. 9, showing securement mechanisms with clasps.
Figure 10:
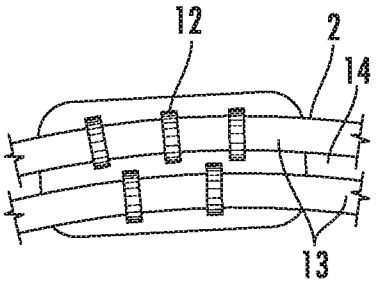
FIG. 10 illustrates a bottom plan view of one or more examples of embodiments of a floatation device, showing a floatation device having a plurality of securement mechanisms secured to a multi-part bow or split brace or limb.
Figure 12:
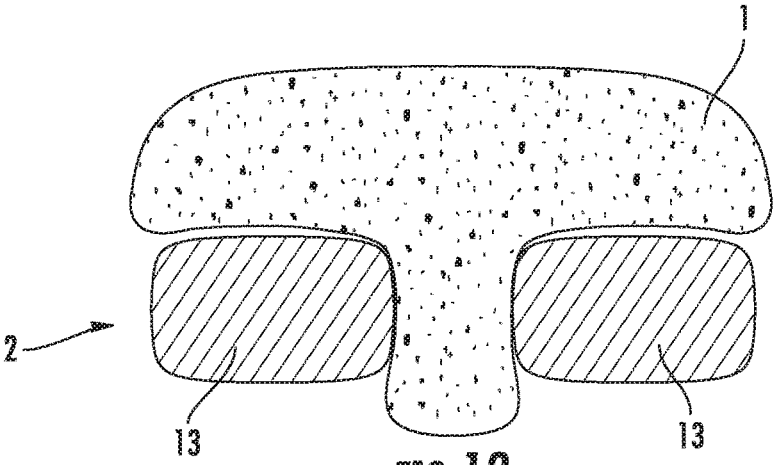
FIG. 12 illustrates a cutaway end elevation view of one or more alternative examples of a floatation device, showing a floatation device that fits between two portions of a split bow limb.
Figure 13:
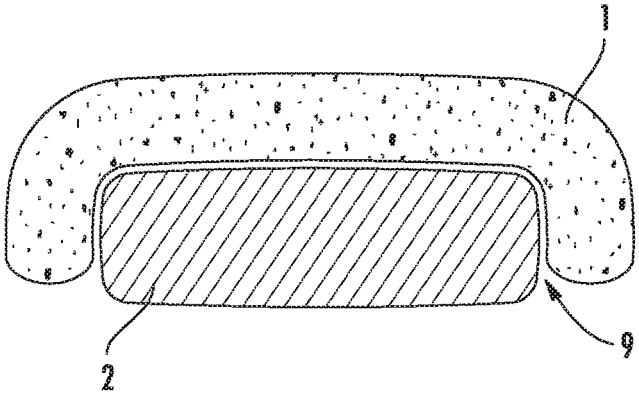
FIG. 13 illustrates a cutaway end elevation view of one or more alternative examples of a floatation device, showing a floatation device that contacts the top and sides of the outside of the bow limb, such as may be used with an adhesive.

As shown in FIG. 3, the ends of straps 4 and/or 5 may fasten to each other to secure the floatation device 1 to a bow limb 2. A variety of connection mechanisms may be used to secure the ends of the straps 4 and/or 5 to one another. To this end, the securing mechanism is comprised of at least one strap 4 with a connection mechanism selected from a group consisting of hook and eye, snaps, buttons, hook and loop (such as Velcro®), buckle or other known or future developed materials or other means well known in the art. Alternative connection mechanisms for securement of the floatation device 1 to a bow limb 2 may include clasps as shown in FIGS. 9-10. FIG. 9 shows one or more examples of embodiments of a securing mechanism or fastener, and in particular a clasp 12. The securing mechanism may be comprised of at least one pressure clasp. For example, the clasp 12 secures the buoyant member 3 on the bow limb 2 by exerting pressure against the bow limb 2 to hold the buoyant member 3 to the bow limb 2. One example of a pressure-based system is a cam-type mechanism which may be used to secure the floatation device 1 against the bow limb 2. Alternatively, the securing mechanism may be semi-rigid and sized to provide a gap slightly narrower than the bow limb 2, into which the bow limb 2 is placed; for example, a frictional engagement such as shown in FIGS. 12-13. As shown in FIG. 10, a clasp 12 may alternatively be provided which circumnavigates all or a portion of the bow limb 2. For example, a bow limb 2 may be comprised of two longitudinal pieces 13 with a space 14 in between the longitudinal pieces 13 as can be seen in FIG. 10. In this example of embodiments, the clasp 12 may surround one or more individual longitudinal pieces 13 of the bow limb 2. The clasp may be formed of any suitable rigid, durable material and preferably a material which does not rust. Examples of such materials include, but are not limited to metal such as stainless steel, or hard plastic, or other known or future developed material, or any like materials well known in the art.

Figure 11:
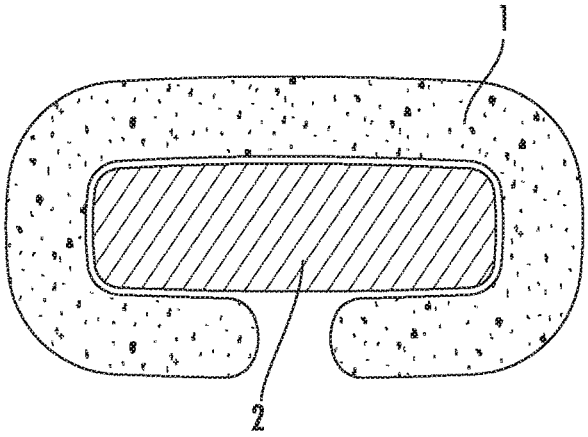
FIG. 11 illustrates a cutaway end elevation view of one or more alternative examples of a floatation device, showing a floatation device that wraps around to contact the top, bottom and both sides of the outside of the bow limb.

In one or more alternative examples of embodiments, a floatation device 1 may be secured on the bow limb 2 without the use of a fastener or securement mechanism 4 and/or 5. In other words, the buoyant member 3 may be secured on the bow limb 2 without a "strap." The shape of the floatation device 1 itself may form the means or mechanism of securement of the floatation device 1 to the bow limb 2 (e.g., through friction). For example, the floatation device 1 does not require a separate securement mechanism 4 and/or 5 but rather is secured/securable to the bow limb 2 based upon the shape of the buoyant member 3, and consequently is secured on the bow limb 2 at least in part by a friction fit. Adhesive may also be used. Various examples are shown in FIGS. 11-13. According to one or more examples of embodiments, friction or adhesion between the bow limb 2 and the buoyant member 3 may assist to keep the floatation device 1 in place. As illustrated, the buoyant member 3 may be formed with a shape which curls or wraps around a portion of the bow limb 2 (e.g., is in contact with the top 6, the sides 7, and bottom 8) (FIG. 11). In an alternative example of embodiments in which a split or two part or two piece bow limb 2 is provided, the buoyant member 3 may be formed with a projection or extension arranged to fit between the respective split bow limbs 2 (FIG. 12). In alternative examples of embodiments, it may not be necessary for the buoyant member 3 to touch the bottom of a bow limb 2 (an example of which is shown in FIG. 13). Each of the previously disclosed securement means or mechanisms allow the floatation device 1 to be removed from the bow limb 2 at will. However, it is also contemplated that the floatation device 1 may be permanently or semi-permanently secured. For example, an adhesive strip may be provided on the bottom 8 of buoyant member 3. Other adhesives such as glue, epoxy, or other known or future developed materials, or other such means known in the art may also be used that allows securement that does not materially diminish the flexibility and integrity of the bow limb 2. While adhesives are disclosed, the buoyant member 3 may also be permanently or semi-permanently secured by a mechanical fastener such as, but not limited to, bolts, screws, or pegs that would attach to the buoyant member 3 and bow limb 2. In one or more further examples of embodiments, it is contemplated that the buoyant member 3 or floatation device 1 may be integrally formed or incorporated into the overall design of bow 19 and/or bow limb 2. Moreover, while specific examples are provided herein, the floatation device 1 described herein may be used with any now known or future developed bow design (e.g., including variations in designs, enhancements, materials, and the like). As a non-limiting example, the bow may be a floatable bow or buoyant bow.

Figure 14:
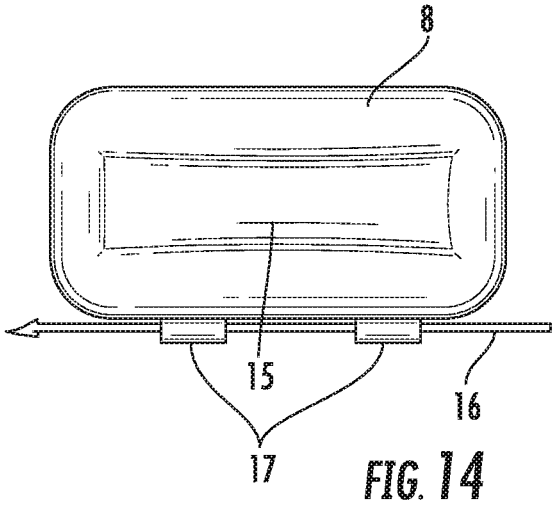
FIG. 14 illustrates a plan view of one or more examples of embodiments of a floatation device for use with an arrow.
Figure 15:
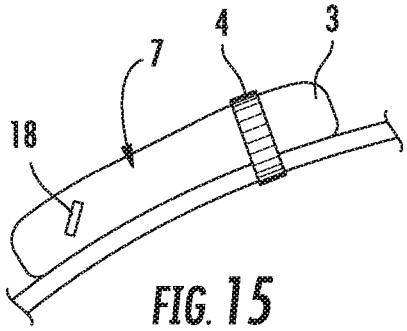
FIG. 15 illustrates a side elevation view of one or more examples of embodiments of a floatation device, showing the floatation device secured to a bow and having an arrow retention mechanism for an arrow.
Figure 18:
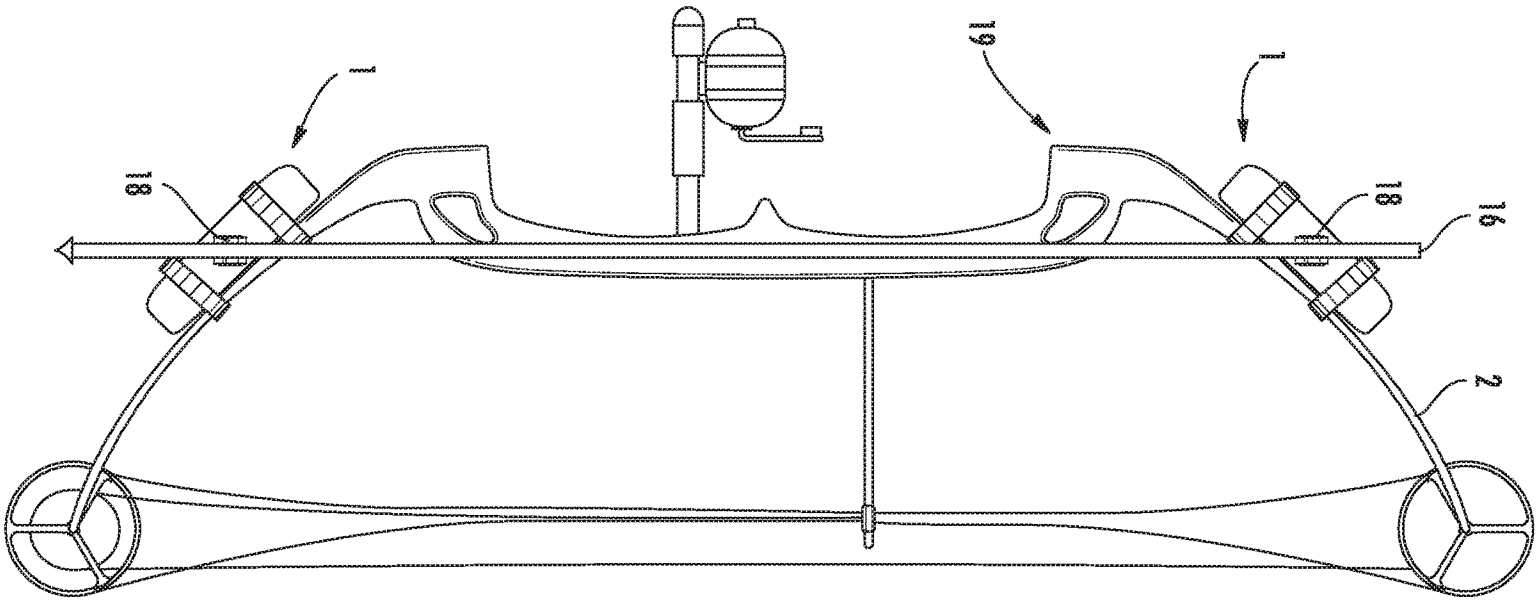
FIG. 18 illustrates a side elevation view of an aquatic archery bow having one or more examples of embodiments of floatation devices secured thereto, and also showing an arrow held or retained on the floatation devices.

As shown in FIGS. 14, 15, and 18, the floatation device(s) 1 may also be secured to, retain, or removably secure a projectile, such as an arrow 16. In this regard, the floatation device 1 may have an arrow retention mechanism 18 located at the top 6 or side 7 of the buoyant member 3 that removably or detachably holds a projectile. As shown in FIG. 14, an arrow 16 may be held or retained by one or more slots, clasps, or tubes 17 on a floatation device 1. These arrow retention mechanisms 18 may be provided in any suitable location on the floatation device 1. For example, the arrow retention mechanism 18 may be connected to the top 6 or side 7 of the buoyant member 3, although variations thereon would not depart from the overall scope of the present invention.

The arrow retention mechanism 18 may also be located on the floatation device 1 or the securing mechanism 4 and/or 5 (e.g., strap) such as is shown in FIG. 15 and FIG. 18. The arrow retention mechanism 18 may also be located on the securement mechanism or mechanical fastener (e.g., strap 5 or clasp 12) as well as, or alternatively on the platform 11. In one or more further examples of embodiments, an example of which is shown in FIG. 15, the arrow retention mechanism 18 is a formed recess provided in a surface, such as side 7, of the buoyant member 3. The arrow retention mechanism 18 may be a slit or receptor in an outer surface of the buoyant member 3. Alternatively, an arrow 16 may also simply slide in between the side 7 of the buoyant member 3 and a strap 4. One with skill in the art would understand that numerous mechanisms may be used to retain an arrow 16 or more than one arrow 16 to the buoyant member 3. As a non-limiting example, a magnet (such as but not limited to a neodymium magnet) may be provided under an outer surface of the buoyant member 3. The arrow 16 may be held or retained with a corresponding magnetic member (e.g., a metallic item such as a metal screw, ring, magnet, or segment) that would mate with the magnet on the buoyant member 3. This arrow magnetic member may be provided, for example, as a part of an arrow slide or nock, or alternatively, the metal arrow tip may be secured to the magnet. As a result, the arrow 16 could be held and detachably retained to the buoyant member 3 in a number of orientations.

Figure 16:
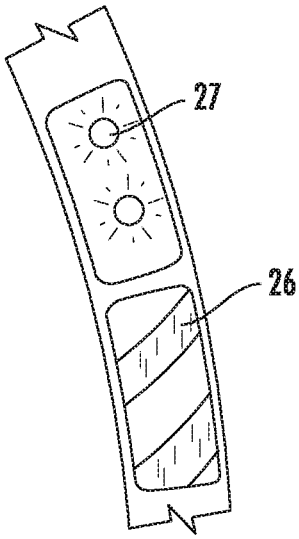
FIG. 16 illustrates a partial plan view of one or more examples of embodiments of a floatation device, showing examples of features provided on the floatation device to increase visibility.

As previously indicated, it is also desirable to improve the visibility of the bow, particularly when floating. In this regard, a portion, or all, of the floatation device 1 or securement mechanisms 4 and/or 5 may be made of materials that increase visibility. Material of increased visibility may be used on any or all of the following: the covering or outer surface of the buoyant member 3, the securement mechanism 4 and/or 5, and/or the flexible platform 11. One example is shown in FIG. 16. A variety of materials may be used to increase visibility. For example, the material may be brightly colored or reflective. Likewise, one or a plurality of reflectors 26 may be attached to the surface of the buoyant member 3. While it is contemplated that visibility may be increased by use of the foregoing materials, it is also contemplated that a component or portion of the floatation device 1 may not be made of such material, and instead may be camouflaged or provided in a variety of colors and/or patterns to reflect customer preferences or other known or future developed material.

In another example of embodiments, visibility may be increased by the addition of lights. For example, a light 27 or more than one light 27 may be attached at or near the surface of the buoyant member 3. As shown in FIG. 16, lights 27, including but not limited to light emitting diodes, and additionally or alternatively, reflectors 26 may be added to the floatation device 1, whether embedded or on the surface of the flotation device 1 to increase visibility. Enhanced visibility features, such as lights 27, may be powered by battery or solar or other water resistant mechanisms. As indicated, these enhanced visibility features are useful to an operator when trying to retrieve the bow, especially in low light conditions (such as glow-in-the-dark paint).

Figure 17:
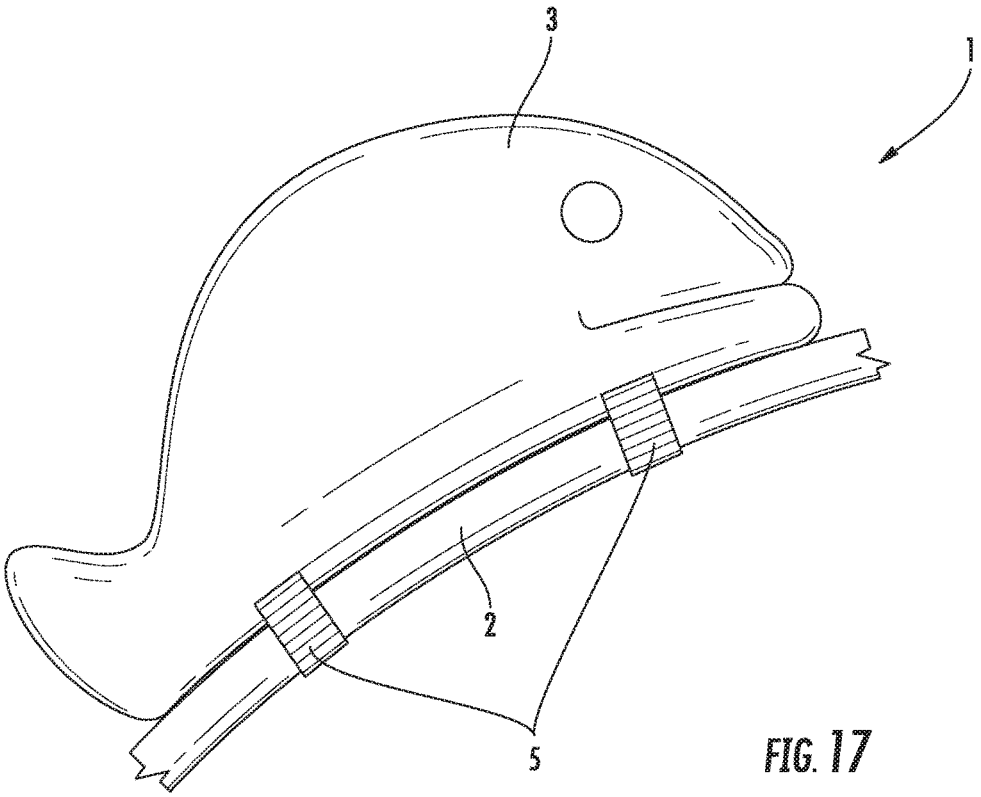
FIG. 17 illustrates a side elevation view of one or more alternative examples of embodiments of a floatation device, showing a floatation device formed into the shape of a fish and secured on a portion of a bow.

In one or more further examples of embodiments, the floatation device 1 may be provided with a fanciful shape. For example, the buoyant member 3 may be shaped into the form of a fish (FIG. 17). While a fish is specifically illustrated, one with skill in the art would understand that any shape may be provided without departing from the overall scope of the present invention. The fanciful shape may be used in combination with one or more of the above-described features. For example, the floatation device 1 may comprise a buoyant member 3 composed of urethane closed cell foam formed into the shape of a fish and coated in brightly colored vinyl with a plurality of reflectors attached to the surface of the buoyant member 3. The securing mechanism 4 and/or 5 may be at least one strap 4 with a hook and loop connection means. The securing mechanism 4 and/or 5 secures the floatation device 1 to the bow limb 2 and may be attached to the floatation device 1. An arrow retention mechanism 18 that detachably holds or retains a projectile may also be located on the top 6 or side 7 of the buoyant member 3.

One or more examples of operation of the floatation device 1 will now be described in reference to the Figures. To use the floatation device 1, the operator may place the floatation device 1 on the exterior or interior of a bow limb 2. The operator may use a single floatation device 1 or multiple flotation devices such as shown in FIG. 18. Preferably, the operator uses a plurality of floatation devices 1, and in particular two floatation devices 1. The number of floatation devices 1 added to the bow may be accomplished for a variety of purposes, examples of which include but are not limited to, to customize the level of buoyancy and to customize the visibility of the bow to the operator, which features are balanced against maintaining the sight lines of the bow, the flexibility of bow, and/or other considerations as may be affected by mounting accessories onto a bow. Once the number and position of the floatation device(s) 1 are determined, the operator secures the floatation device(s) 1 onto the bow limb 2 using one of the securing mechanisms 4 and/or 5 as described above. The floatation device 1 then remains on the bow for as long as the operator desires, but likely for at least the duration of an aquatic archery session. If securing purposes is temporary, the floatation device 1 may then be removed. Removal may be desired for cleaning or storage or simply to use the floatation device 1 on another bow. One or more arrows 16 may also be held or retained on the floatation device 1 by inserting the arrow 16 into the arrow retention mechanism 18. When secured on the bow, the floatation device(s) 1 will flex with the bow limbs 2 when the bow is used. The floatation device 1 also functions to float on top of the water in such a way that at least the portion of the bow to which the floatation device 1 is secured will remain on top of the water.

As shown in FIG. 18, a plurality of floatation devices 1 can be secured to bow limbs 2 without dramatically impacting the use of the bow 19. In addition, an arrow 16 may be stored by using the arrow retention mechanisms 18 on the floatation device 1 to allow an arrow 16 to be close at hand.

The floatation device 1 having the features described herein provides various advantages over existing devices. When secured to a bow, the floatation device 1 ensures that the aquatic bow is less likely to sink when in a body of water. Namely, by adding the floatation device 1 to the bow, if the bow is dropped into the water it will remain at or near the surface, which dramatically increases the ease and likelihood of retrieving it. By adding other features such as lights 27, bright colors, or reflective materials 26, the visibility is also increased making the floatation device 1 even more easily found and retrieved. Advantageously, the floatation device 1 may also be permanently secured or removably secured. Moreover, the floatation device 1 is flexible in such a way that it may flex with the bow, and sized in such a way that it does not affect the use of the bow or sightlines thereof.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled," or "secured," or "attached" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached or coupled or secured to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g., by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

What is claimed is:

1. A floatation device for an archery bow comprising:

a buoyant member defined by a top, a bottom, and one or more sides, wherein the top and the bottom extend the longitudinal length of the buoyant member, and wherein the bottom is arranged to meet an arch of an archery bow limb;

a securing mechanism arranged to secure the buoyant member on the arch of the archery bow limb such that the bottom of the buoyant member is in contact with the bow limb.

2. The floatation device of claim 1, wherein the bottom of the floatation device comprises a flexible platform, and the flexible platform has a plurality of buoyant members fixed thereto.

3. The floatation device of claim 1, wherein the securing mechanism is a strap.

4. The floatation device of claim 3, wherein the securing mechanism is a plurality of straps.

5. The floatation device of claim 1, wherein the securing mechanism is a frictional engagement.

6. The floatation device of claim 1, wherein the securing mechanism comprises at least one strap with a connection mechanism selected from a group consisting of hook and eye, snaps, buttons, hook and loop, and buckle.

7. The floatation device of claim 1, wherein the buoyant member is fixed to the securing mechanism.

8. The floatation device of claim 1, wherein the buoyant member comprises a closed cell foam.

9. The floatation device of claim 1, wherein the buoyant member comprises urethane.

10. The floatation device of claim 1, wherein the buoyant member comprises a watertight covering.

11. The floatation device of claim 1, wherein the buoyant member comprises a closed cell foam having a watertight covering.

12. The floatation device of claim 1, further comprising a light attached to the buoyant member.

13. The floatation device of claim 1, further comprising a reflector attached to the buoyant member.

14. The floatation device of claim 1, wherein the floatation device has an arrow retention mechanism arranged for detachably retaining a projectile.

15. The floatation device of claim 1, wherein the buoyant member comprises a closed cell foam formed into the shape of a fish and is brightly colored.

16. The floatation device of claim 15, wherein the securing mechanism comprises at least one strap having a hook and loop connection means.

17. The floatation device of claim 16, further comprising a plurality of reflectors attached to the buoyant member.

18. The floatation device of claim 17, wherein an arrow retention mechanism is attached to the buoyant member and detachably holds a projectile.

19. A floatation device for an archery bow having at least one bow limb with a top, at least two sides and a bottom, the floatation device comprising:

a buoyant member having a recess defined in the bottom of the buoyant member and extending the longitudinal length of the buoyant member, wherein the recess is shaped to meet an arch of the at least one bow limb, and wherein the floatation device is secured to the bow limb in such a way that a surface of the recess of the buoyant member is in contact with the at least one archery bow limb.

20. An aquatic archery bow comprising:

a plurality of bow limbs; and a floatation device secured to a bow limb from the plurality of bow limbs, wherein the floatation device comprises a buoyant member, the buoyant member defined by a top, a bottom, and one or more sides, wherein the top and the bottom extend the longitudinal length of the buoyant member, and wherein the buoyant member is carried by an arch of the bow limb and secured to the bow limb so as to engage the bottom of the buoyant member with the bow limb; and wherein the floatation device further comprises an arrow retention mechanism attached to the buoyant member which detachably holds a projectile.

21. The aquatic archery bow of claim 20, wherein the buoyant member is integral with the bow limb.

* * * * *